US007114927B2

(12) United States Patent
Bachofner et al.

(10) Patent No.: US 7,114,927 B2
(45) Date of Patent: Oct. 3, 2006

(54) FIXING METHOD FOR THE BLADING OF A FLUID-FLOW MACHINE AND FIXING ARRANGEMENT

(75) Inventors: Rene Bachofner, Untersiggenthal (CH); Wolfgang Kappis, Fislisbach (CH)

(73) Assignee: ALSTOM Technology Ltd., Baden (CH)

( * ) Notice: Subject to any disclaimer, the term of this patent is extended or adjusted under 35 U.S.C. 154(b) by 170 days.

(21) Appl. No.: 10/958,423

(22) Filed: Oct. 6, 2004

(65) Prior Publication Data

US 2005/0074335 A1 Apr. 7, 2005

(30) Foreign Application Priority Data

Oct. 6, 2003 (DE) ..... 103 46 239

(51) Int. Cl.
*F01D 5/32* (2006.01)

(52) U.S. Cl. ..... 416/213 R; 416/215; 416/204 A; 29/889.21; 29/889.22

(58) Field of Classification Search ..... 416/213 R, 416/215, 216, 219 R, 220 R, 204 A; 29/889.21, 29/889.22

See application file for complete search history.

(56) References Cited

U.S. PATENT DOCUMENTS 2,281,318 A * 4/1942 Neufeld ..... 416/215

FOREIGN PATENT DOCUMENTS

DE 820 598 7/1949
DE 101 34 611 A1 6/2002

OTHER PUBLICATIONS

Search Report from DE 103 46 239.2 (Jan. 21, 2004).

* cited by examiner

*Primary Examiner*—Edward K. Look
*Assistant Examiner*—Richard A. Edgar
(74) *Attorney, Agent, or Firm*—Cermak & Kenealy, LLP; Adam J. Cermak

(57) ABSTRACT

A fixing method for blading of a fluid-flow machine, in which first of all the turbine blades ($\mathbf{3}_1$, $\mathbf{3}_2$) are inserted into the fastening slot (1) of a rotor (2) or stator until only the intermediate fitting gap is left, into which two insert elements designed as end piece halves ($\mathbf{4}_1$, $\mathbf{4}_2$) are then inserted. After that, a wedge (6) is inserted into the gap between the end piece halves ($\mathbf{4}_1$, $\mathbf{4}_2$), and the end piece halves ($\mathbf{4}_1$, $\mathbf{4}_2$) together with the wedge (6) are welded by a joining weld (10). With the method according to the invention and the arrangement according to the invention, axial forces which can warp the rotor (2) and thus cause increased rotor vibrations are advantageously avoided. The invention also relates to a fixing arrangement according to the invention.

10 Claims, 2 Drawing Sheets

FIXING METHOD FOR THE BLADING OF A FLUID-FLOW MACHINE AND FIXING ARRANGEMENT

This application claims priority under 35 U.S.C. § 119 to German application number 103 46 239.2, filed 6 Oct. 2004, the entirety of which is incorporated by reference herein.

BACKGROUND OF THE INVENTION

1. Field of the Invention

The invention relates to a fixing method for the blading of a fluid-flow machine and to a fixing arrangement.

2. Brief Description of the Related Art

The fixing of the blading of the above type relates to moving or guide blades inside fluid-flow machines, such as, for example, a compressor or a turbine of a gas turbine plant or another thermal turbomachine. Moving blades are fastened in a fastening slot along the circumference of the rotor of the thermal turbomachine. They are to be positioned in a suitable manner as a function of the respective flow conditions and are to be reliably secured with respect to misalignments which occur or against complete release from the fastening slot during operation of the thermal turbomachine.

There is the risk of individual moving blades being completely released from the circumferential slot if the moving blades are unevenly displaced within the respective fitting clearance in the circumferential direction along the fastening slot on the rotor. Due to such peripheral misalignments, with a multiplicity of moving blades inserted along the fastening slot, a considerable gap may arise between two adjacent moving blades, this gap being large enough for a moving blade to be released from the fastening slot by radial twisting. This may cause considerable damage to the entire turbomachine plant.

Safety measures against the release of individual moving blades from the fastening slot generally relate to the reduction of the clearance between two adjacent blade roots inside the fastening slot. After the fitting of all the moving blades inserted into the fastening slot and of the whole intermediate pieces and the halved intermediate pieces, an "intermediate fitting gap", into which a "rotor end piece" is inserted, is obtained between two opposite moving blades. This ensures that the clearance present between the moving blades, inserted into the fastening slot, and intermediate pieces is limited to a minimum.

However, on account of the varying thermal expansion behavior between the blades, the rotor end piece and the rotor during operation, a clearance is produced between the blades and the intermediate pieces, located inside the fastening slot, including the rotor end piece. On account of the circumferential clearance arising in the process, a situation may arise in which the end piece halves are displaced relative to one another in such a manner in the circumferential direction along the fastening slot. The intermediate piece may then be released, for example, from the heart-shaped recesses. Such a case leads in turn to the damage scenario already described at the beginning.

In order to prevent such damage, DE-A1-101 34 611 describes a fixing arrangement for blading of a fluid-flow machine in which an intermediate fitting gap is provided between at least two turbine blades inserted in an adjacent position inside the fastening slot. The two insert elements, designed as end piece halves, are inserted into the intermediate fitting gap. These insert elements enclose a gap between them into which a fixing wedge can be inserted. The wedge is characterized by the fact that it provides at least one connecting element toward the side of the turbine blade and at least one of two turbine blades adjoining the wedge provides a mating contour corresponding to the connecting element. Thus the wedge and the turbine blade form a positive-locking connection with one another.

A disadvantage of this embodiment, however, is that additional axial forces are thereby produced, which act on the rotor. These axial forces may lead to the rotor becoming warped, thus causing increased rotor vibrations.

SUMMARY OF THE INVENTION

One aspect of the present invention includes the development of a fixing arrangement of the generic type in such a way that the vibration behavior described above can be ruled out. The relevant measures are to be as simple as possible in terms of design and are to be cost-effective in implementation.

Axial forces which can warp the rotor and thus cause increased rotor vibrations can advantageously be avoided with this arrangement.

BRIEF DESCRIPTION OF THE FIGURES

The invention is described by way of example below with the aid of an exemplary embodiment and with reference to the drawings, in which.

Only the features essential for the invention are shown.

DETAILED DESCRIPTION OF THE PREFERRED EMBODIMENTS

Figure 1:
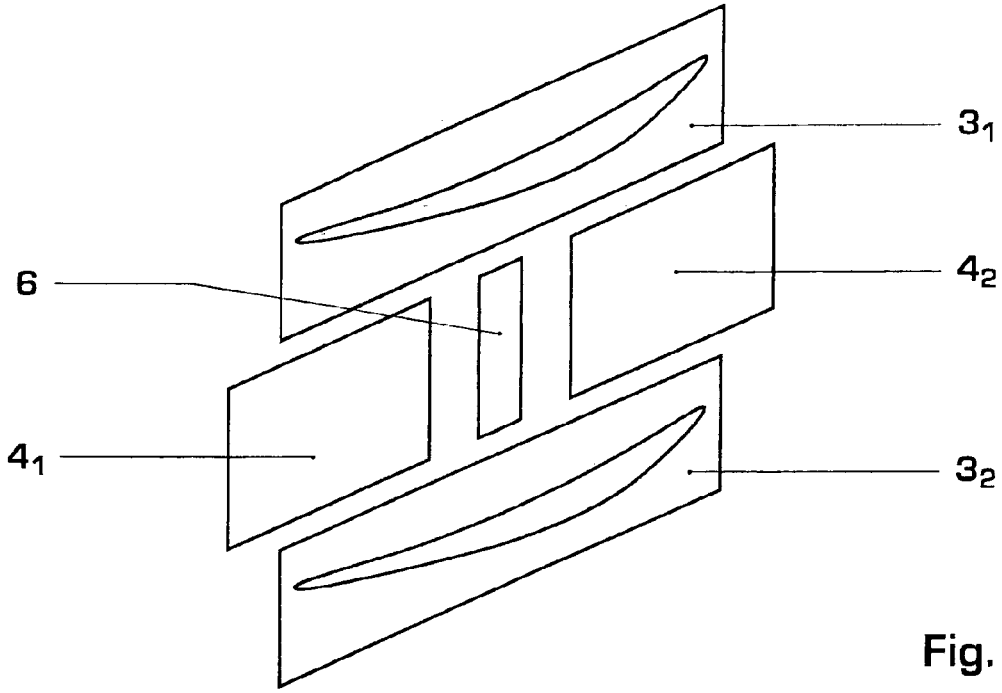
FIG. 1 shows an illustration of individual components in a plan view.
Figure 2:
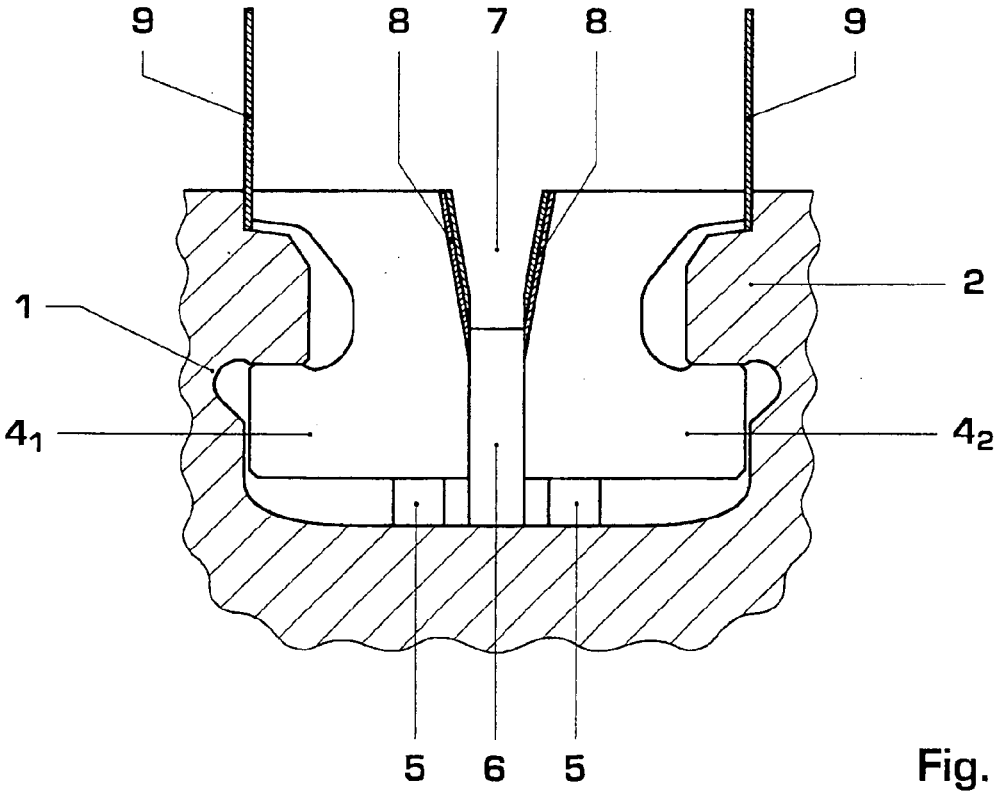
FIGS. 2–4 show a section through a rotor end piece designed according to the invention in various fitting stages.
Figure 3:
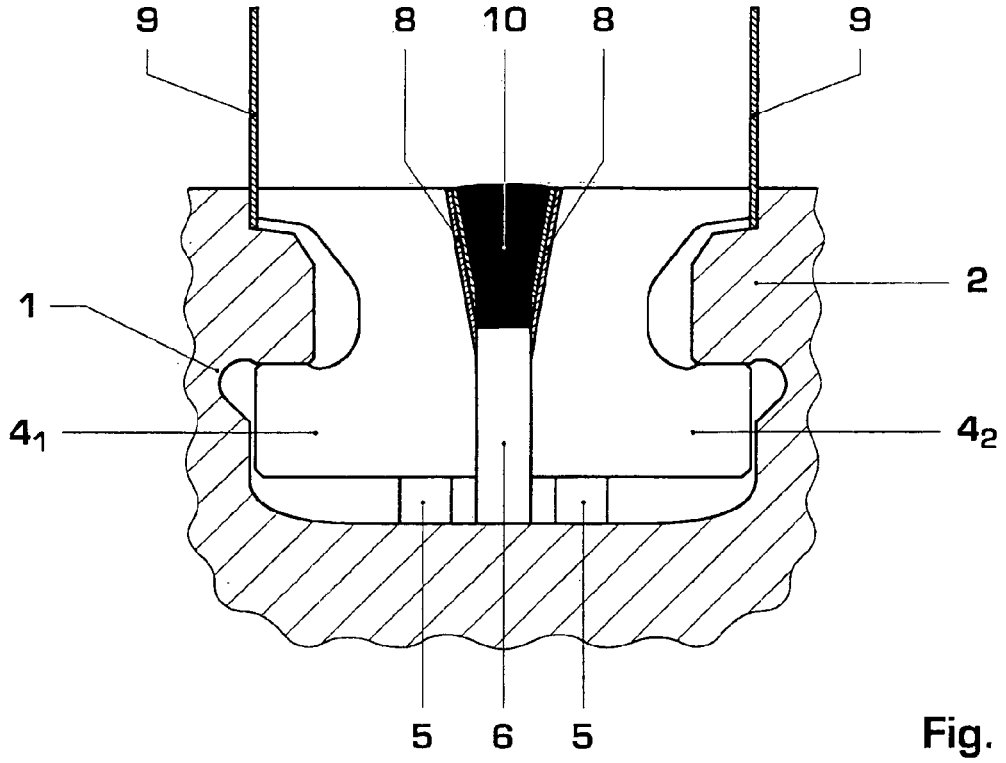
Figure 4:
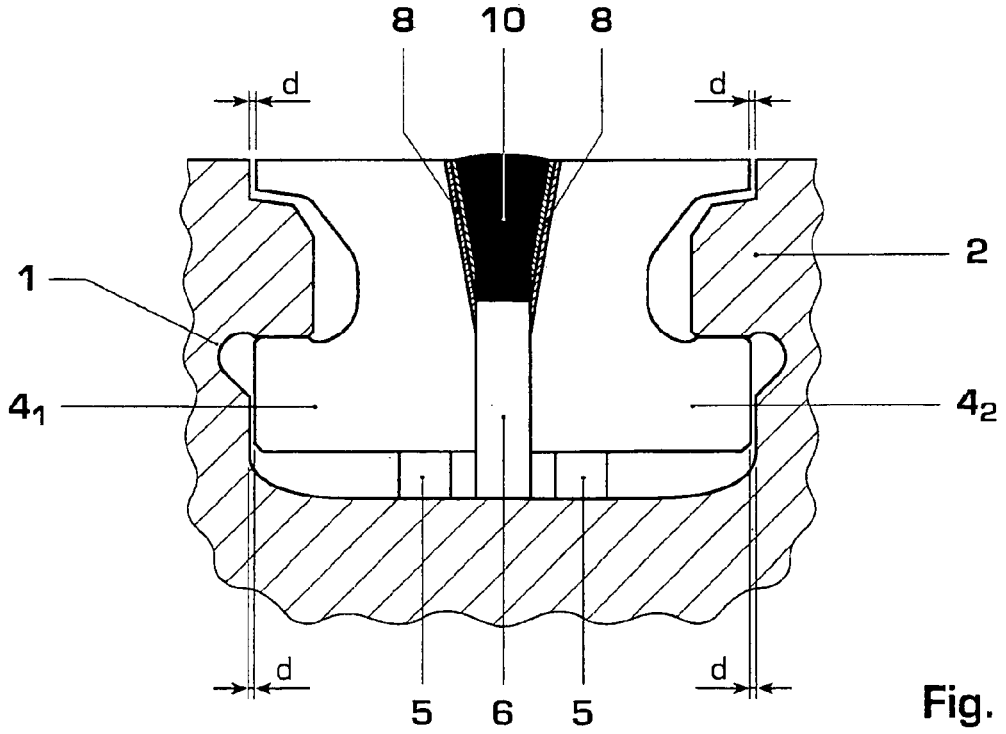

FIG. 1 shows a plan view of a fixing arrangement according to the invention, consisting of two turbine blades $\mathbf{3}_1$, $\mathbf{3}_2$ fitted inside a fastening slot 1 (not shown) and of a rotor end piece located between the turbine blades $\mathbf{3}_1$, $\mathbf{3}_2$. The turbine blades $\mathbf{3}_1$, $\mathbf{3}_2$ may be, for example, moving or guide blades of a compressor, a gas turbine or another thermal turbomachine. The rotor end piece consists of two end piece halves $\mathbf{4}_1$, $\mathbf{4}_2$ and has a wedge 6 arranged between the end piece halves $\mathbf{4}_1$, $\mathbf{4}_2$. The present invention relates to a method of fitting such a rotor end piece. The individual method steps of the fitting method according to the invention are shown schematically in FIGS. 2 to 4. FIGS. 2 to 4 show a section through the two end piece halves $\mathbf{4}_1$, $\mathbf{4}_2$, which are inserted in the fastening slot 1 along the circumference of the rotor 2 of the fluid-flow machine. Within the scope of the invention, however, this may also involve the stator of the fluid-flow machine.

The fitting operation consists in first of all inserting all the turbine blades $\mathbf{3}_1$, $\mathbf{3}_2$ and all the intermediate pieces or halved intermediate pieces along the circumference of the rotor 2 in the fastening slot 1 until only an intermediate fitting gap is left for the rotor end piece. FIG. 2 now shows a section through the rotor end piece according to the invention. It can be seen from FIG. 2 that first of all the end piece halves $\mathbf{4}_1$, $\mathbf{4}_2$ are inserted into the intermediate fitting gap. The end piece halves $\mathbf{4}_1$, $\mathbf{4}_2$ (and the wedge 6) have a width adapted to the width of the intermediate fitting gap and enclose a gap between them. Toward the root of the fastening slot 1, the end piece halves $\mathbf{4}_1$, $\mathbf{4}_2$ each have a support 5. The wedge 6 is then inserted into the gap between the two end piece halves $\mathbf{4}_1$, $\mathbf{4}_2$. The two end piece halves $\mathbf{4}_1$, $\mathbf{4}_2$ are fixed inside the fastening slot 1 in a positive-locking manner by the wedge 6. The wedge 6 has no further retaining lugs or other axial fastenings as are known from the prior art. An intermediate space 7 is located between the end piece halves $\mathbf{4}_1$, $\mathbf{4}_2$ above the wedge 6. A buffer weld 8 may be located on the surface of the end piece halves $\mathbf{4}_1$, $\mathbf{4}_2$ which is oriented toward this intermediate space 7, so that materials which are not so easy to weld may also be used. Sheet-metal shims 9 are fitted between the fastening slot 1 and the two end piece halves $\mathbf{4}_1$, $\mathbf{4}_2$ in order to achieve axial clearance between fastening slot 1 and rotor end piece.

As can be seen from FIG. 3, the two end piece halves $\mathbf{4}_1$, $\mathbf{4}_2$ and the wedge 6 are then welded to one another in the intermediate space 7 by the joining weld 10. The function of a whole intermediate piece is achieved by the welding of the two end piece halves $\mathbf{4}_1$, $\mathbf{4}_2$, which intermediate piece, however, is not supported as known in the prior art in the axial direction on the two end piece halves $\mathbf{4}_1$, $\mathbf{4}_2$, on the turbine blades $\mathbf{3}_1$, $\mathbf{3}_2$ or in the fastening slot 1. After the joining weld 10 has cooled down, the sheet-metal shims 9 are removed (cf. FIG. 4), so that a clearance d remains between the fastening slot 1 and the two end piece halves $\mathbf{4}_1$, $\mathbf{4}_2$ and no additional axial forces act on the rotor 2.

Axial forces which can warp the rotor 2 and thus cause increased rotor vibrations are advantageously avoided with the method according to the invention and the arrangement according to the invention.

LIST OF DESIGNATIONS

1 Fastening slot in the rotor 2
2 Rotor
$\mathbf{3}_1$, $\mathbf{3}_2$ Turbine blades
$\mathbf{4}_1$, $\mathbf{4}_2$ End piece halves
5 Support
6 Wedge
7 Intermediate space
8 Buffer weld
9 Sheet-metal shims
10 Joining weld
d Clearance While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A fixing method for blading of a fluid-flow machine, the method comprising:

inserting a plurality of turbine blades and intermediate pieces along a fastening slot;

providing an intermediate fitting gap between at least two of the plurality of turbine blades inserted in an adjacent position inside the fastening slot;

wherein inserting the turbine blades and intermediate pieces comprises inserting into the fastening slot until only the intermediate fitting gap for the rotor end piece is left;

inserting two insert elements comprising end piece halves into the intermediate fitting gap, the end piece halves having a width adapted to the width of the intermediate fitting gap and enclosing a gap therebetween;

inserting a wedge into the gap between the end piece halves, so that an intermediate space remains between the end piece halves above the wedge; and welding the end piece halves together with the wedge inside the intermediate space with a joining weld.

2. The method as claimed in claim 1, further comprising, before said welding, fitting sheet-metal shims between the fastening slot and a respective end piece half; and removing the sheet-metal shims after said welding.

3. The method as claimed in claim 1, comprising:

applying a buffer weld to the surfaces of the end piece halves which are oriented toward the intermediate space; and welding the end piece halves together with the wedge inside the intermediate space at the buffer weld.

4. The method as claimed in claim 1, wherein said turbine blades comprise moving blades fitted in a fastening slot of a rotor; or wherein said turbine blade comprise guide blades fitted in a fastening slot of a stator.

5. The method as claimed in claim 1, wherein said turbine blades comprise the blading of a compressor or of a turbine.

6. A fixing arrangement for blading of a fluid-flow machine, comprising:

a fastening slot;

a plurality of turbine blades and intermediate pieces inserted along the fastening slot and forming an intermediate fitting gap between at least two of the plurality of turbine blades inserted in an adjacent position inside the fastening slot;

two insert elements comprising end piece halves inserted into the intermediate fitting gap, the end piece halves having a width adapted to the width of the intermediate fitting gap and enclosing a gap between them;

a wedge inserted into the gap between the end piece halves; and a joining weld welding the end piece halves together with the wedge above the wedge.

7. The fixing arrangement as claimed in claim 6, further comprising:

an axial clearance between the fastening slot and a respective end piece half.

8. The fixing arrangement as claimed in claim 6, further comprising:

a buffer weld applied between each of the end piece halves and the joining weld.

9. The fixing arrangement as claimed in claim 6, wherein the turbine blades comprise moving blades and the fastening slot comprises a fastening slot of a rotor; or wherein the turbine blades comprise guide blades and the fastening slot comprises a fastening slot of a stator.

10. The fixing arrangement as claimed in claim 6, wherein the fluid-flow machine comprises a compressor or a turbine.

* * * * *